US006581653B2

(12) United States Patent
Servadei

(10) Patent No.: US 6,581,653 B2
(45) Date of Patent: Jun. 24, 2003

(54) SEALED ROTARY JOINT FOR CONNECTING A LIQUID FEED PIPE TO THE ROTATING SUPPLY CONTAINER OF A FILLING MACHINE

(75) Inventor: Giovanni Servadei, Faenza (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/009,121

(22) PCT Filed: Apr. 9, 2001

(86) PCT No.: PCT/IB01/00602

§ 371 (c)(1),
(2), (4) Date: Dec. 4, 2001

(87) PCT Pub. No.: WO01/79108

PCT Pub. Date: Oct. 25, 2001

(65) Prior Publication Data

US 2003/0098318 A1 May 29, 2003

(30) Foreign Application Priority Data

Apr. 14, 2000 (IT) ..... BO2000A0216

(51) Int. Cl.[7] ..... B65B 1/04

(52) U.S. Cl. ..... 141/144; 53/381.1

(58) Field of Search ..... 141/144–152; 53/381.1, 385.1, 386.1, 564, 570

(56) References Cited

U.S. PATENT DOCUMENTS 4,949,766 A * 8/1990 Coatsworth ..... 141/67
5,240,049 A * 8/1993 Chiari ..... 141/81
6,338,371 B1 * 1/2002 Araki et al. ..... 141/145

FOREIGN PATENT DOCUMENTS

FR 2044458 A 2/1971
FR 2612168 A 9/1988

* cited by examiner

*Primary Examiner*—Steven O. Douglas
(74) *Attorney, Agent, or Firm*—William J. Sapone; Coleman Sudol Sapone, P.C.

(57) ABSTRACT

A device for feeding liquid substances in filling machine for filling bottles and the like includes a first tubular member (4), which is integral with a stationary structure (1) of the machine (M) and a second tubular member (5) made integral with a rotating head (6) of the machine (M). The tubular members (4,5) are coaxial and have head surfaces tightly connected to each other by means of a first, upper ring (8) and a second, lower ring (9). The upper ring (8) and lower ring (9) are made of ceramic material and touch each other with their flat surfaces (8A,9A).

9 Claims, 2 Drawing Sheets

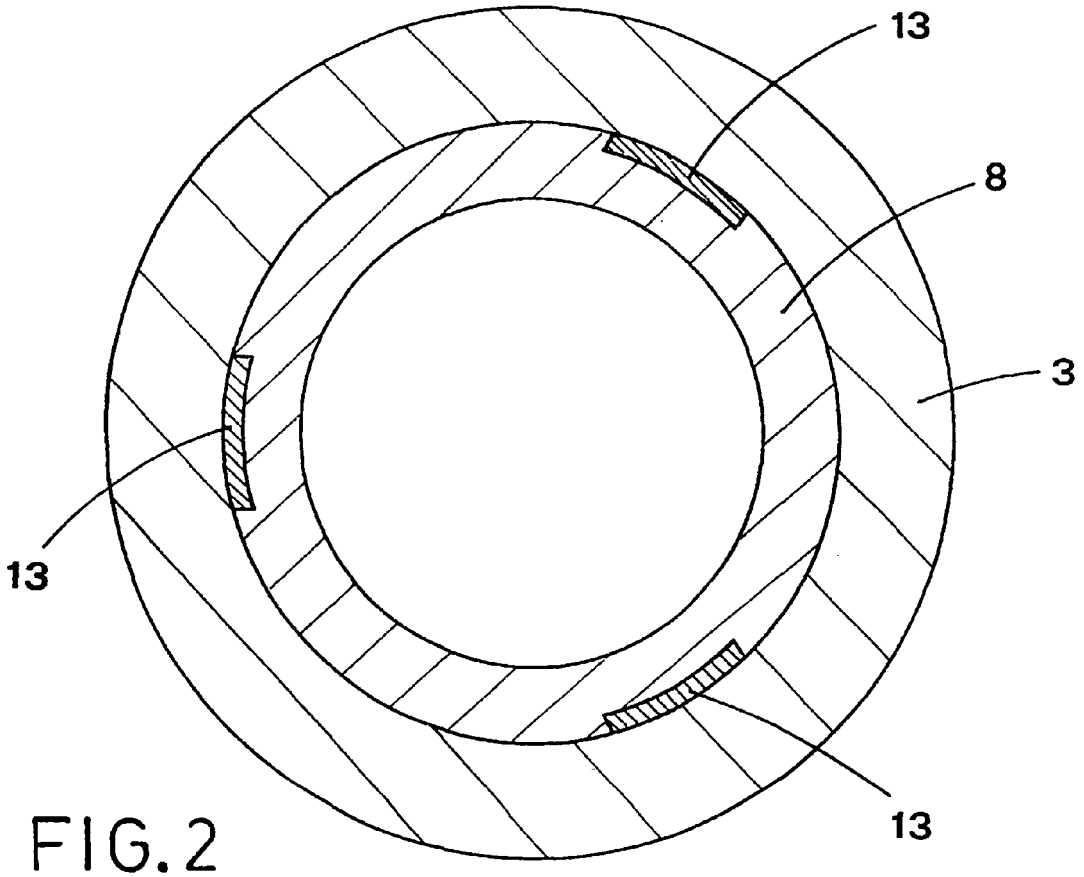
FIG. 2
FIG. 3
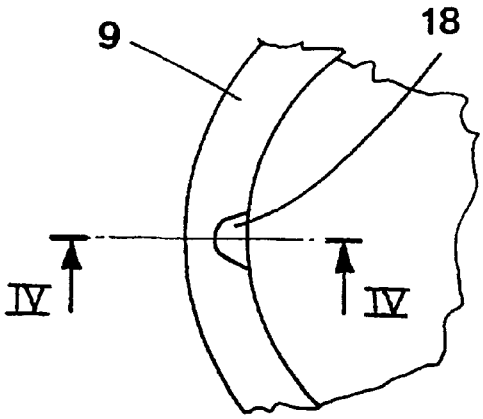
FIG. 4
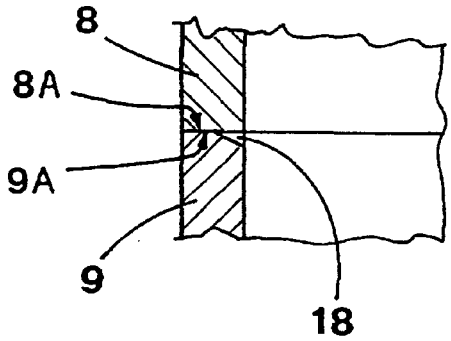

SEALED ROTARY JOINT FOR CONNECTING A LIQUID FEED PIPE TO THE ROTATING SUPPLY CONTAINER OF A FILLING MACHINE

BACKGROUND OF THE INVENTION

The present invention relates to filling bottles and the like with liquid substances.

More precisely, the invention relates to a device for feeding liquid substances in filling machines for filling bottles and the like, with absence of leaks.

DESCRIPTION OF THE PRIOR ART

In automatic machines for filling bottles with measured quantities of liquid substances, e.g. in pharmaceutical industry, the liquid substances are fed to a rotating head equipped with supplying-measuring means, which fill the bottles.

In particular, the liquid substances must pass from a motionless part of the machine to the above mentioned rotating head, ensuring that the necessary tightness is maintained.

For this purpose, there are known devices including telescopically coupled tubular elements, fastened to the motionless part and to the rotating head.

The known devices usually do not manage to avoid liquid leaks.

According to another known solution, stacked and compressed sealing rings makes a tight seals in the radial direction and are placed between the stationary part and the rotating head.

Thus, a pack tight-sealing is obtained using synthetic resin materials, e.g. Teflon, which create powders and/or tiny particles which can contaminate liquid substances.

The disadvantage of the above mentioned solution lies in the presence of wear phenomenon, which requires frequent check and adjusting operations, more precisely re-calibration operations.

SUMMARY OF THE INVENTION

The object of the present invention is to solve the above mentioned problem by proposing a device, which allows an efficient feeding of liquid substances in machines for filling bottles and the like, while keeping a tight-seal.

Another object of the present invention is to propose a device, which allows a feeding of liquid substances by a simple, functional and versatile structure, which does not contaminate the liquid substances, while keeping a perfect tight-seal.

A further object of the present invention is to propose a device, which does not require re-calibration after having been used together with the filling machine.

The above mentioned objects are obtained, in accordance with the contents of the claims, by means of a device for tight feeding liquid substances in a filling machine for filling bottles and the like, the filling machine having a stationary support structure and a rotating filling head, the device being characterized in that it includes:

- a first tubular member connected with said stationary structure of said filling machine;
- a second tubular member, which is connected to said rotating head of the machine, said second tubular member being set coaxial with and tightly connected to said first tubular member;
- an upper ring joined to said first tubular member;
- a lower ring joined to said second tubular member and kept touching said upper ring.

BRIEF DESCRIPTION OF THE DRAWINGS

The characteristic features of the present invention will be pointed out in the following description of a preferred, but not only embodiment, with reference to the enclosed drawings, in which:

FIG. 2 is an enlarged, cross-section view of the proposed device, taken along the plane II—II of FIG. 1;

FIG. 3 is a cross-section view of a particular of the proposed device, taken along the plane III—III of FIG. 1;

FIG. 4 is a section view of the particular of FIG. 3, taken along the plane IV—IV of FIG. 3.

BEST MODE OF CARRYING OUT THE INVENTION

Figure 1:
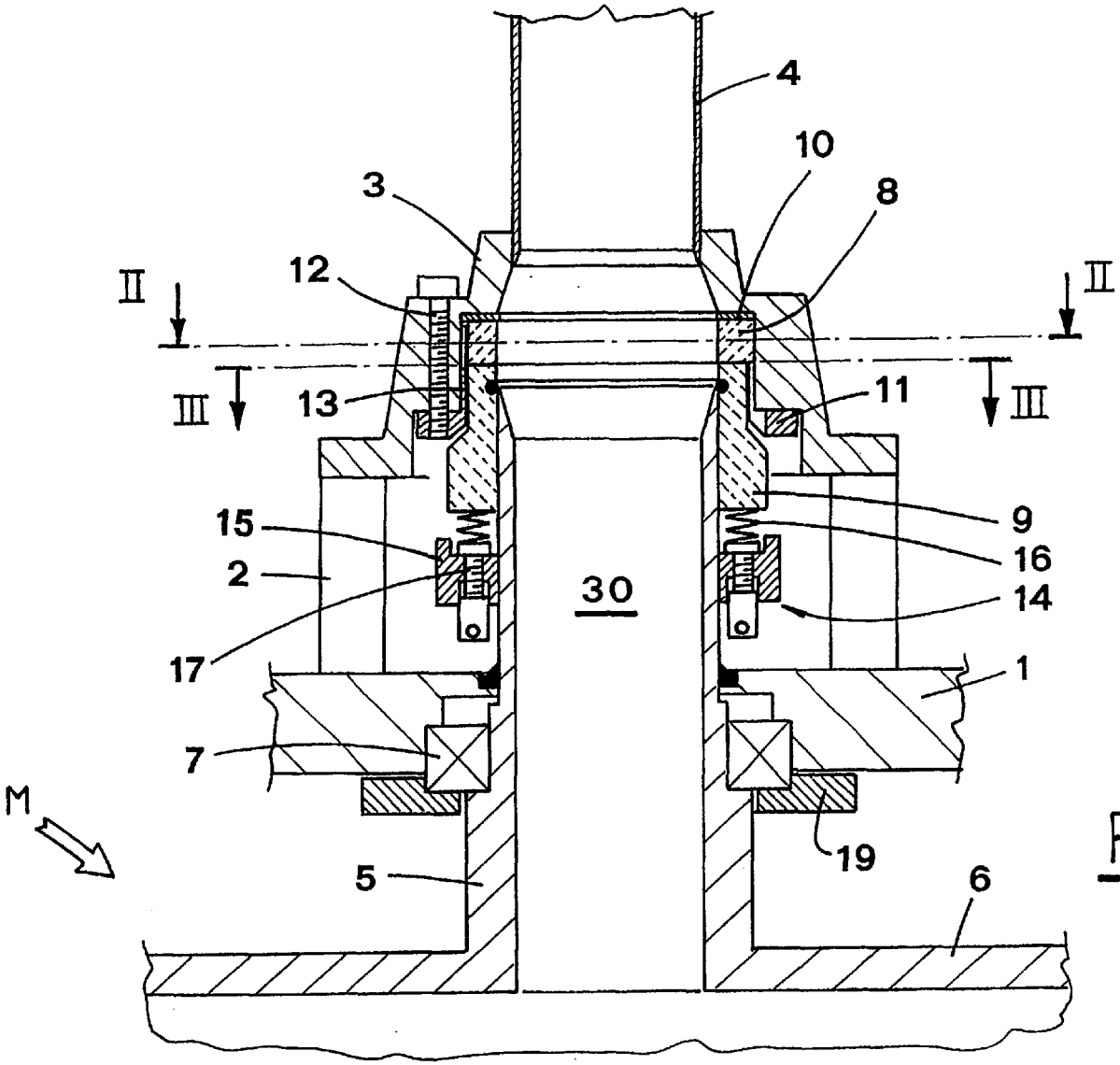
FIG. 1 is a section view taken along a vertical median plane, of the proposed device for tight feeding of liquid substances.

With reference to the above figures, reference numeral 1 indicates a stationary structure of a machine M for filling bottles and the like (not shown).

The structure 1 supports, by means of columns 2, a cup-like sleeve 3, whose cavity is turned downwards.

A tubular vertical member 4, delivering liquid, is fastened to the sleeve 3.

The structure 1 features an aperture, through which a second tubular member 5 passes. The second tubular member extends vertically from a rotating head 6 and is fastened to the structure 1 by a suitable rolling-contact bearing 7, kept by a locknut 19.

The first tubular member 4 and the second tubular member 5 are set in coaxial relation.

The front parts of the tubular members 4, 5 are tightly connected by an upper ring 8 and a lower ring 9, made of ceramic material.

The flat surfaces 8A, 9A of the tubular members 4, 5, suitably polished and normal with respect to the axes of the respective rings 8, 9, touch each other (FIG. 4).

The upper ring 8 is situated at the bottom of the sleeve 3, touching a washer 10.

The upper ring 8 is held by a fastening ring 11, which is mounted to the sleeve 3 by screw means 12.

The fastening ring 11 forms a series of tabs 13, turned upwards, which enter corresponding shaped grooves made on the outer surface of the upper ring 8, so as to prevent the latter from rotating (see also FIG. 2).

The lower ring 9, rotating together with the second tubular element 5, is held in contact with the upper ring 8 by elastic pushing means 14, which are fastened to a clamp ring15.

The clamp ring 15 is connected to the outer part of the second tubular member 5.

The two flat surfaces 8A, 9A of the rings 8, 9 touch each other.

The pushing means 14 include helical springs 16, pushing against the base of the lower ring 9 and resting on adjusting screws 17, which are screwed into corresponding threaded seats made in the clamp ring 15.

The lower ring 9 features also a recess 18 made in the flat surface 9A, touching the relative flat surface 8A of the upper ring 8, as seen in FIGS. 3 and 4.

The recess 18 receives a quantity of liquid for moistening the flat surfaces BA, 9A, so as to prevent them from gluing and to lubricate them.

The operation of the device is easily understood from the above description.

The rings 8 and 9 of ceramic material, fastened respectively to the stationary part and to the rotating head of the machine, create an efficient tightness between the tubular members 4 and 5 during liquid feeding.

The lower ring 9 is held in contact with the upper ring 8 by a limited adjustable pressure of the elastic pushing means 14.

It is to be noted that the inner diameter of the rings 8, 9 of ceramic material is bigger that the diameter of the tubular members 4, 5, so as to widen the channel 30 defined by the tubular members 4, 5.

This is advantageous as it reduces the radial push of the liquid in correspondence to the contact surfaces 8A, 9A.

The proposed device achieves the object to tightly feed liquid substances in the machines for filling bottles and the like, without leaks.

One of the advantages of the proposed device results from the use of rings made of ceramic material, whose characteristic features are similar to those of glass, thus allowing the contact surfaces 8A, 9A to be almost perfectly smooth and very hard.

Actually, the contact surfaces 8A, 9A are not worn, thus no contaminating particles are created.

The described and illustrated technical solution allows to avoid re-calibration, due to the lack of wear of the sealing means, i.e. surfaces 8A, 9A mutually in contact with the rings 8, 9;

in other words the proposed device must be calibrated only in the beginning of its working.

What is claimed is:

1. A filling machine for filling bottles comprising a stationary support structure, a rotatable filling head and a device for liquid tight feeding of liquid substances to the bottles, the device having a first tubular member connected with the stationary support structure, a second tubular member connected to the rotatable filling head, the second tubular member disposed coaxial with and connectable to the first tubular member, an upper ring joined to the first tubular member and, a lower ring joined to the second tubular member, contactable with the upper ring.

2. The filling machine of claim 1 wherein the upper ring and the lower ring each have a flat surface normal to an axis of a respective ring, the flat surfaces being mutually contactable.

3. The filling machine of claim 1 wherein the upper ring and the lower ring are made of a ceramic material.

4. The filling machine of claim 1 further comprising elastic pushing means, fastened to an outer part of the second tubular member, the lower ring rotatable integrally with the second tubular member, the elastic pushing means biasing the lower ring into contact with the upper ring.

5. The filling machine of claim 4 wherein the elastic pushing means is a helical spring, and further comprising at least one adjusting screw engaged with the helical spring, and, a clamp ring, fastened to the second tubular member and having a threaded seat for receiving the at least one adjusting screw therein.

6. The filling machine of claim 1 further comprising a cup shaped sleeve integral with the first tubular member, the upper ring located at a bottom of the sleeve.

7. The filling machine of claim 6 further comprising a fastening ring for holding the upper ring mounted to the sleeve and having a series of tabs, the upper ring having corresponding shaped grooves on an outer surface thereof for receiving the tabs therein.

8. The filling machines of claim 1 wherein at least one recess is made in a contacting surface of the lower ring, the contacting surface of the lower ring contacting an upper contacting surface of the upper ring, the recess receiving a liquid to lubricate the upper and lower contacting surfaces.

9. The filling machine of claim 1 wherein the first tubular member and the second tubular member define a channel, an inner diameter of the upper ring and the lower ring being larger than an inner diameter of the first tubular member and the second tubular member to define a wider channel therebetween.

* * * * *